US005669421A

United States Patent [19]

Lehnert et al.

[11] Patent Number: 5,669,421

[45] Date of Patent: Sep. 23, 1997

[54] METHOD OF CONTROLLING THE YARN TENSION IN A WEAVING MACHINE

[75] Inventors: Frank Lehnert, Rüti; Godert De Jager, Benglen, both of Switzerland

[73] Assignee: Sulzer Ruti AG, Switzerland

[21] Appl. No.: 537,558

[22] Filed: Oct. 2, 1995

[30] Foreign Application Priority Data

Oct. 17, 1994 [EP] European Pat. Off. ..... 94810604

[51] Int. Cl.[6] ..... D03D 47/34; D03D 49/18

[52] U.S. Cl. ..... 139/1 R; 364/470; 364/921.1; 395/904

[58] Field of Search ..... 364/470, 921.1; 139/1 R, 194, 435.1; 395/900, 904

[56] References Cited

U.S. PATENT DOCUMENTS

| | | | |
|---|---|---|---|
| 5,134,568 | 7/1992 | Sainen | 139/105 |
| 5,155,691 | 10/1992 | Sainen | 139/1 R |
| 5,295,515 | 3/1994 | Kato | 139/435.1 |
| 5,320,142 | 6/1994 | Sainen | 139/1 R |
| 5,321,621 | 6/1994 | Sainen | 139/1 R |
| 5,322,089 | 6/1994 | Yamada | 139/1 R |
| 5,440,495 | 8/1995 | Sainen et al. | 139/435.1 |
| 5,476,122 | 12/1995 | Schuster et al. | 139/194 |

FOREIGN PATENT DOCUMENTS

| | | |
|---|---|---|
| 0 634 509 | 1/1995 | European Pat. Off. . |
| 2 568 595 | 2/1986 | France . |
| 40 08 864 | 9/1991 | Germany . |
| 43 23 748 | 7/1994 | Germany . |

OTHER PUBLICATIONS

Wulfhorst, Burkhard et al., "Weft Yarn Strain Reduction by Means of a Newly Developed Regulated Weft Yarn Brake", *Textil Praxis International*, 1991, vol. 12, pp. 1292–1298.

*Primary Examiner*—Andy Falik

*Attorney, Agent, or Firm*—Townsend and Townsend and Crew LLP

[57] ABSTRACT

A control curve is calculated for controlling the yarn tension including warp and weft yarn tensions in a weaving loom by comparing a previously determined yarn tension curve with a desired value for the yarn tension curve. The control characteristic is optimized by continuous iteration. A further optimization of the yarn tension curve takes place by taking account of variable parameters in the yarn tension curve, for example yarn breakage analysis, beat-up force of the reed, and/or shed change. The control device for performing the method can be implemented with conventional logic. The method automatically carries out in an advantageous manner for weft and warp yarns a matching to the optimum yarn tension as a function of time on the basis of preselected parameter values.

12 Claims, 5 Drawing Sheets

METHOD OF CONTROLLING THE YARN TENSION IN A WEAVING MACHINE

The invention relates to a method for controlling the yarn tension, in particular for weft yarns and warp yarns in a weaving machine and to a weaving machine for performing the method.

BACKGROUND OF THE INVENTION

During the weaving process, the warp yarns are subjected to varying tensions or loads during shed formation and beating and the weft yarn is also subjected to varying tensions during insertion. To compensate the yarn tension, it is a known method to set a predetermined yarn tension for the specific weft process in hand with the aid of a calculated control characteristic and taking account of the yarn tension values.

The disadvantage of this approach is that the control characteristic can only be changed to a limited degree when the weaving machine is running, with the adjustment of the yarn tension being performed manually with the aid of values gained by experience and with the brake adjustment taking place manually with the aid of previously determined braking parameters and yarn properties.

SUMMARY OF THE INVENTION

A control curve is calculated for controlling the yarn tension including warp and weft yarn tensions in a weaving loom by comparing a previously determined yarn tension curve with a desired value for the yarn tension curve. The control characteristic is optimized by continuous iteration. A further optimization of the yarn tension curve takes place by taking account of variable parameters in the yarn tension curve, for example yarn breakage analysis, beat-up force of the reed, and/or shed change. The control device for performing the method can be implemented with conventional logic. The method automatically carries out in an advantageous manner for weft and warp yarns a matching to the optimum yarn tension as a function of time on the basis of preselected parameter values.

The invention aims to remedy this. The invention, as characterized in the claims, satisfies the object of providing a method for controlling the yarn tension, as well as a weaving machine for performing the method, in which the optimum weft yarn tension setting as a function of time is performed automatically on the basis of prespecified values and in dependence on the weaving process and which is suitable for controlling the yarn tension for warp yarns and/or weft yarns.

The invention is described in the following by means of example only with the aid of the enclosed drawings.

BRIEF DESCRIPTION OF THE DRAWINGS

The invention is described in the following by means of example only with the aid of the enclosed drawings in which.

DESCRIPTION OF THE PREFERRED EMBODIMENTS

Figure 1:
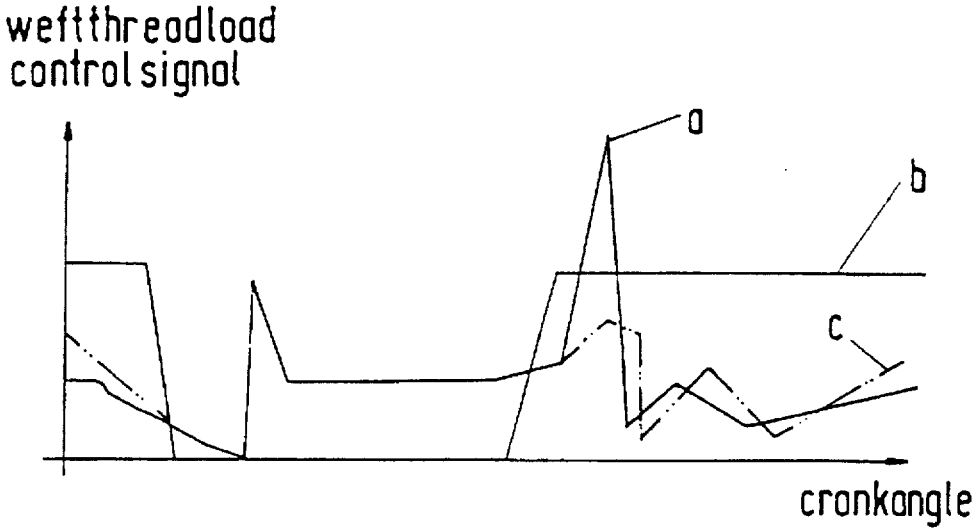
FIG. 1 is a diagram with a pre-specified yarn tension curve and a control characteristic produced by the method of the invention.
Figure 2:
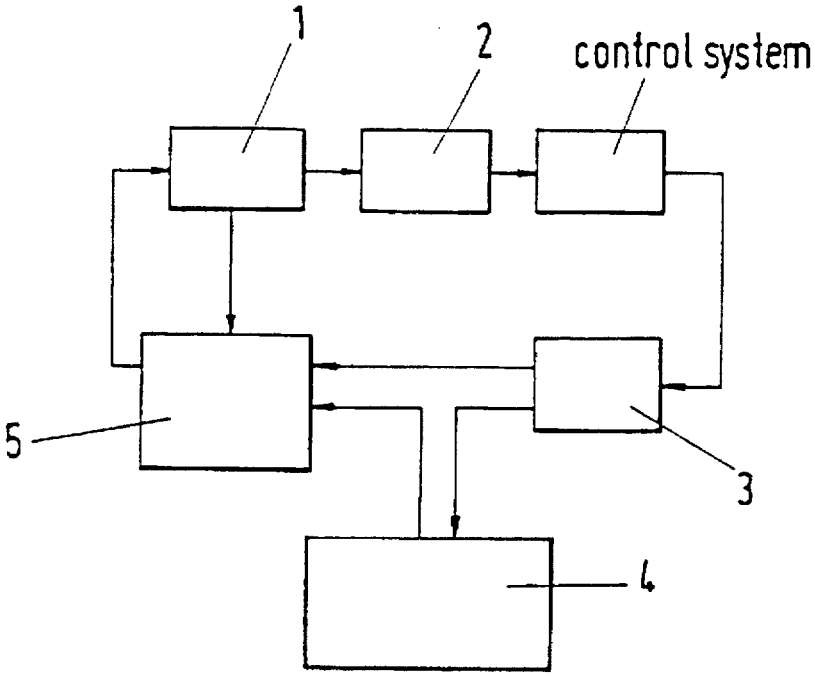
FIG. 2 is a control structure for producing the control characteristic.

FIGS. 1 and 2 are now referred to. In a first step, the yarn tension per weft insertion is measured for each rotational angle and, over a particular number of weft insertions e.g. 50, an average value of the yarn tension is determined for each rotational angle. These are shown as actual yarn tension value data in a curve "a". These actual yarn tension value data are subsequently compared with at least one desired value of the yarn tension. A first approximate control curve "b" is then calculated from this comparison. A new actual yarn tension value curve (curve c) then results from this first control characteristic.

In a further step, a further control characteristic with a smaller deviation between desired and actual values than in the first control characteristic is calculated by comparing the new actual value curve with the desired value of the yarn tension. After a selectable number of weft insertions, the control characteristic is introduced into the control loop.

The desired/actual value deviation can be reduced to a minimum by continuing the comparisons further.

Moreover, a systematic variation of the amplitude and/or the phase in relation to the rotational angle is provided for optimizing the control characteristic. The optimization takes place by holding the amplitude of the control characteristic constant and systematically varying the phase, i.e. the position of the control characteristic, in relation to the rotational angle of the main shaft, for example between ±10°, in order to determine the temporal deviation of the control signal. The amplitude and the phase are then subsequently varied alternatingly. The adjustment with the smallest deviation is stored.

For performing the above-described control, a control structure is used, this being shown in FIG. 2. It comprises a control device 1 which is part of a weaving machine control, an adjustment element 2 provided on the weaving machine, a process controlled system, i.e. the course of the yarn, a device 3 for measuring the yarn tension, a device 4 for inputting parameters and an apparatus 5 for determining the control characteristic.

The above-described control and control structure form a basis implementation with which the yarn tension for weft yarns and/or warp yarns can be controlled and which can be used for example in rapier weaving machines and projectile weaving machines.

During the production of cloth, the yarn tension varies a number of times. The following changes are taken account of by the control in accordance with the invention:

1. The position of the relevant adjustment element which is determined ongoingly by a measurement device.
2. The values of the yarn breakage analysis with which the frequency and the point in time of the yarn breakage are determined with the aid of the yarn tension variation in dependence on the rotational angle of the main shaft, and/or the number of yarn breakages is calculated as a function of time statistically.
3. The number of machine stoppages as a result of irregularities in the course of the yarn.

4. The beat-up force of the reed and/or the shed geometry which are determined from the length change of the warp with the aid of the positional change of the adjustment elements (advantageously the yarn rest).

5. The through-pass time of the inserted weft yarn.

6. The fastener or clip inclination of the warp yarn, etc.

Starting from the above-described basis implementation of the control, the control of the yarn tension is now described along its course for a weft yarn in a projectile weaving machine.

Figure 3:
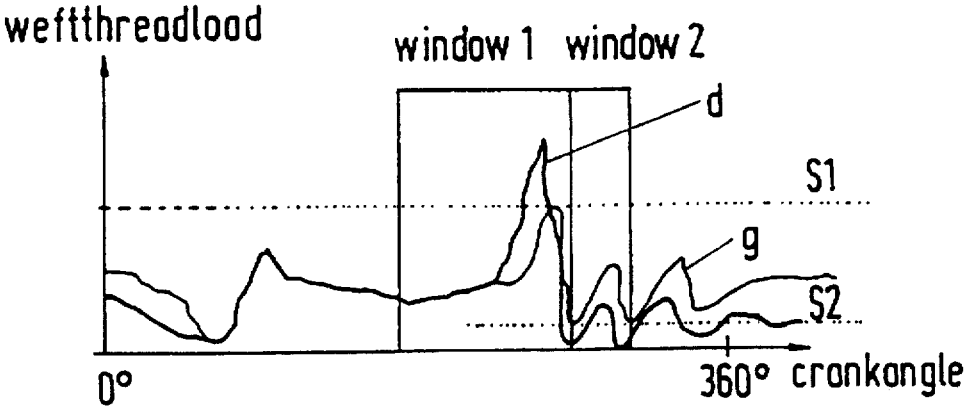
FIGS. 3 and 4 are respectively a diagram of the actual yarn tension value curves and a diagram of the associated control curves taking account of the yarn breakage analysis.
Figure 4:
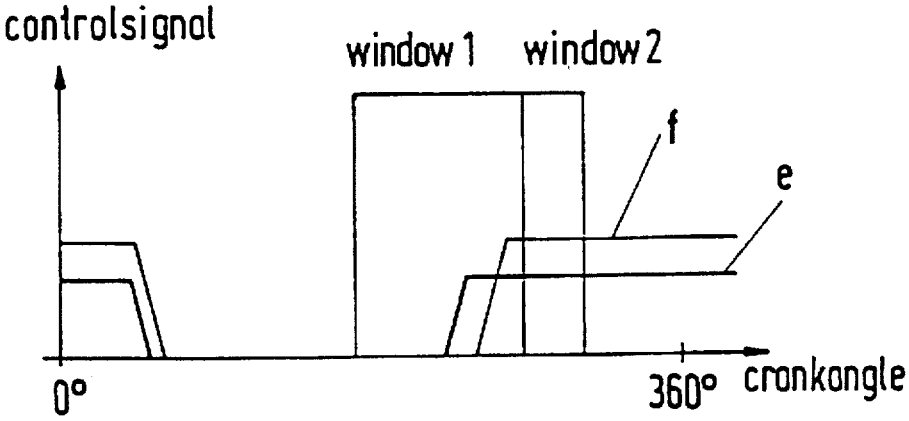

The yarn tension curve (curve d) characteristic for a weft insertion is shown in FIG. 3 and the corresponding first control characteristic (curve e) is shown in FIG. 4.

As shown in FIG. 3, the weft yarn curve comprises a braking phase (window 1) during which the yarn is decelerated and a recovery phase (window 2) during which the inserted weft yarn is pulled back by the yarn tensioner.

The optimization of the yarn tension characteristic curve, i.e. the yarn tension as a function of time, takes place in accordance with the above-described basis implementation of the control in that a desired value curve for a weft insertion, i.e. 360 values, is predetermined. The yarn breakage analysis is also taken into account using the criteria "yarn breakage as a result of excessive yarn tension" and "weft insertion failure as a result of to low a yarn tension". When these events occur, the desired value of the yarn tension is determined anew. The yarn breakage analysis takes place advantageously in the braking and/or recovery phase.

The yarn tension curve of a weft yarn is changed, on the one hand, by the braking force and the point in time at which braking is undertaken as well as, on the other hand, by the properties of the yarn. By a later braking point, the maximum yarn tension (curve d) can be brought to below a desired value S1 during the braking phase (window 1). Subsequently, the yarn tension curve falls off during the recovery phase (window 2). The control reacts to this by increasing the braking force whereby the desired value S2 is exceeded, i.e. the desired range is kept within. As a result of these measures, the second control characteristic (curve f) is calculated so that a new actual value curve (curve g) results. If, subsequently, a yarn breakage occurs as a result of too small a force, the desired value S2 is raised whereas, in the case of a yarn breakage as a result of excessive force, the desired value S1 is reduced. The risk of yarn breakages is taken into account in the control in this manner and the optimum braking force setting is achieved.

Figure 5:
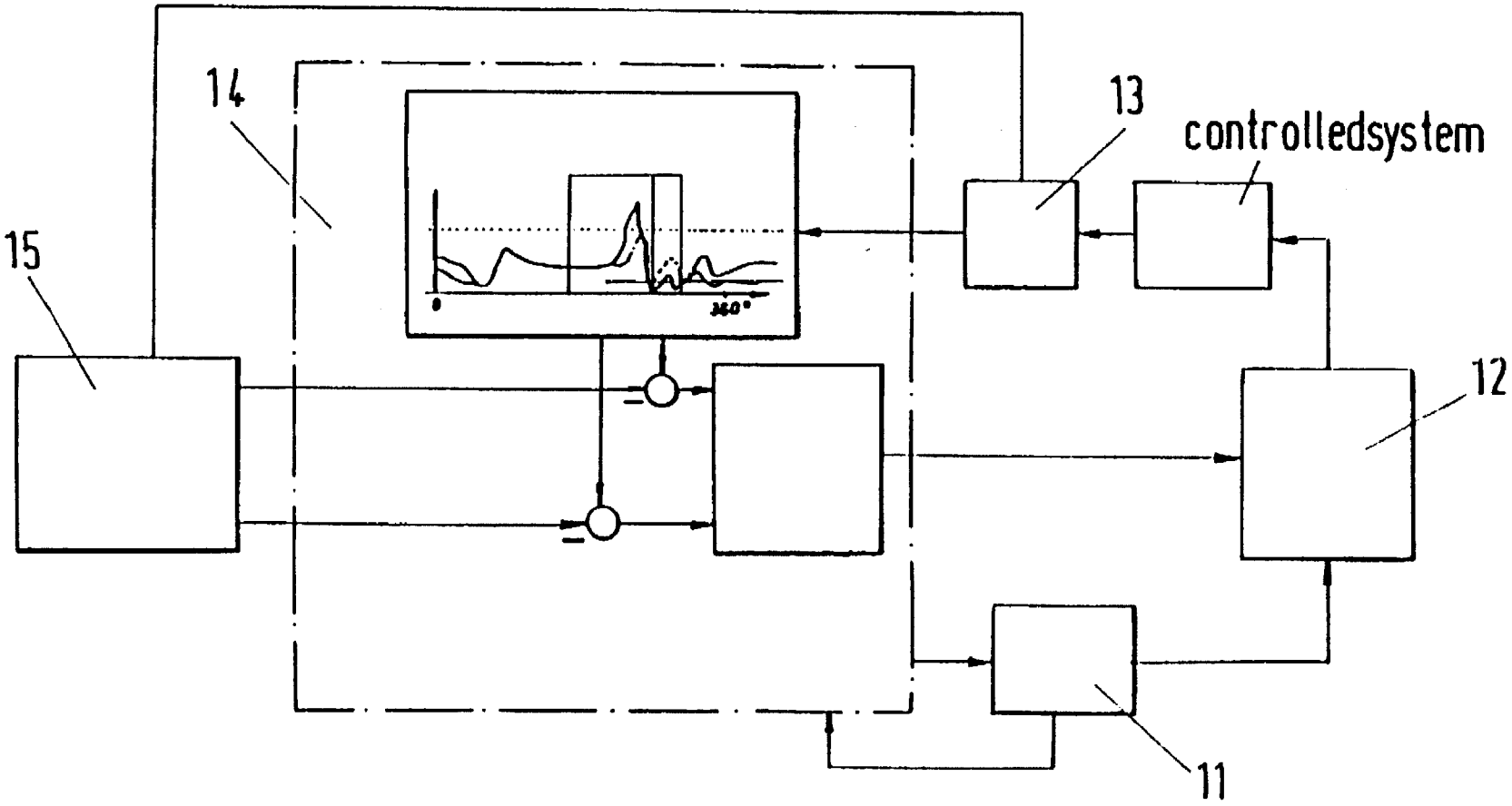
FIG. 5 is a control structure for producing the control characteristic of FIG. 4.

FIG. 5 shows a control structure for performing the control. This control structure comprises a control device 11 which is part of a machine control (not shown), a magnetically actuatable yarn brake 12, the process controlled system, i.e. the weft yarn curve during weft insertion, a pressure meter 13 whose pressure measurement values are proportional to the yarn tension, a device 14 for determining the control characteristic and a device 15 for prespecifying the yarn tension.

Conventional logic or fuzzy-logic can be provided for the control.

Figure 6:
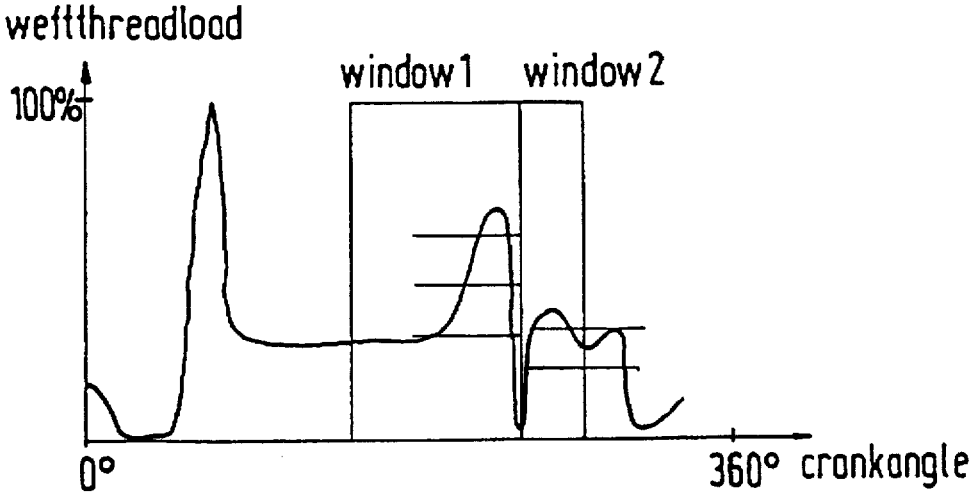
FIG. 6 is a diagram showing the categories in the tension regions when logic is used.

As shown in FIG. 6, for example for the fuzzy-logic for the window 1 the categories "high", "average" and "good" relative to an average yarn tension power are set and for the window 2 the categories "high", "good" and "low" are set, these relating to the absolute values of the yarn tension.

The following rules are given for the adjustment processes:

| Window 1 | Window 2 | Braking Force | Braking Point |
|---|---|---|---|
| high | high | lower | later |
| high | good | — | later |
| high | low | higher | later |
| average | high | lower | — |
| average | good | — | later |
| average | low | higher | — |
| good | high | lower | earlier |
| good | good | — | — |
| good | low | higher | earlier |

Starting from the initially described basis implementation of the control, the control of the course of the yarn is now described in the following for warp yarns in a projectile weaving machine.

Figure 7:
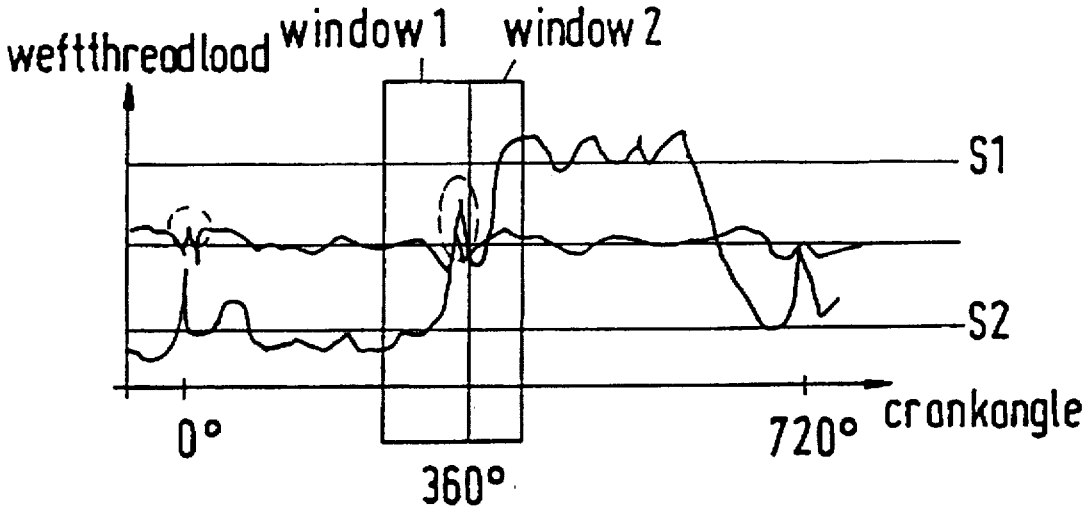
FIGS. 7 and 8 are respectively a diagram of the actual value curves of the warp yarn tension and a diagram of the associated control curves.
Figure 8:
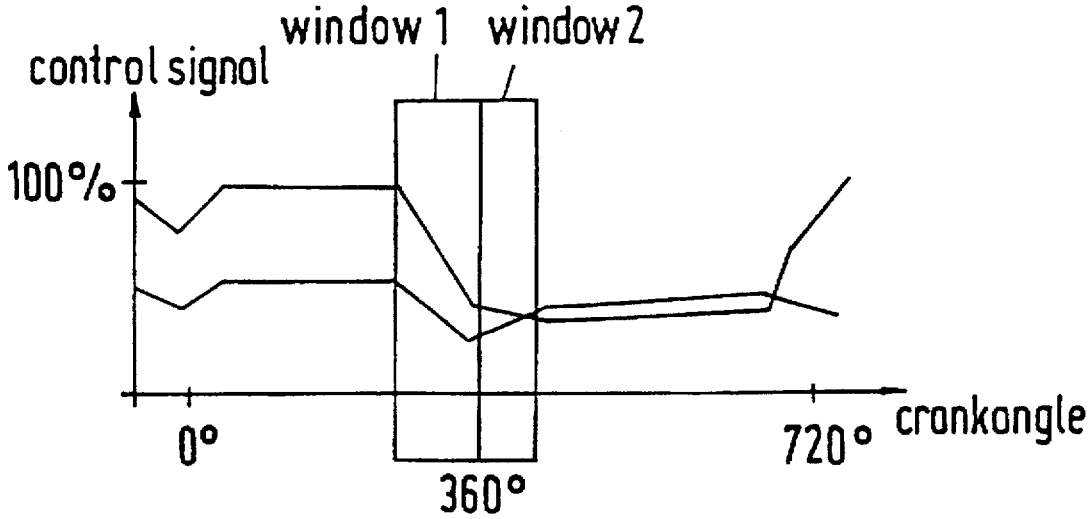

In analogy to FIG. 3 relating to the weft yarn tension curve, FIG. 7 shows a typical warp yarn tension curve and FIG. 8 (analogously to FIG. 4) the corresponding first control characteristic.

The yarn tension curve of the warp yarns is, on the one hand, predetermined by the warp let-off motion or warp regulator, the yarn rest and the cloth take-off device and, as shown in FIG. 7, on the other hand, influenced by the beat-up of the reed (window 1) and the opening of the shed (window 2) so that the warp is subject to a changing tension along its course.

In the initially described basis implementation, the average value of the yarn tension over the full width of the warp or at least over a part of the warp is used as the actual value curve and a yarn tension curve over two weft insertions, i.e. 720 values, as the desired value curve.

The optimization of the yarn tension curve takes place in accordance with the basis implementation.

During this optimization the progression of the warp movement is influenced in accordance with the invention by, in particular, taking account of the processes "reed beat-up" (window 1) and "shed opening" (window 2). This is done using a spring model of the course of the warp/cloth. The cloth and the warp yarns have a particular elasticity and have a spring constant which can be calculated in accordance with formula $$k=\Delta F\times L/\Delta L$$

and the value of the spring constant can be determined by tensile measurements. In the above, $\Delta F$=yarn tension change L=warp length from the edge of the cloth to the release line of the warp beam $\Delta L$=warp yarn length change The warp yarn length change is given by $$\Delta L=\Delta F\times L/k$$

If L and k are taken as constant it follows that $\Delta L$ is proportional to $\Delta F$. $\Delta F$ is brought to approaching zero by continuous amplitude and phase optimization. Since this is performed via the tension change at the reed beat-up and via the shed opening, an optimum course of movement of the adjustment element is obtained in an advantageous manner and subsequently a minimum variance in the warp tension.

The warp yarn breakage analysis is additionally included for optimizing the yarn tension curve.

The warp yarn breakage analysis includes yarn breakage as a result of excessive yarn tension as well as the cutting of the warp yarns by the fired projectile or the rapier as a result of to low a yarn tension.

If the yarn tension is too high, then, after the occurrence of a number (for example 10) of yarn breakages typical for this, the desired value of the yarn tension is reduced and the control characteristic determined anew.

The cutting of the warp yarns occurs as a result of the fastener or clip inclination of the warp yarns, i.e. yarns wound on the warp beam remain stuck to one another. This leads to the warp yarns hanging down into the opened shed to them being cut by the insertion member.

The fastener or clip inclination is determined in a static manner with the aid of the yarn breakages which occur over, for example 100 000 weft insertions and the situation is remedied by increasing the desired value of the yarn tension curve.

Figure 9:
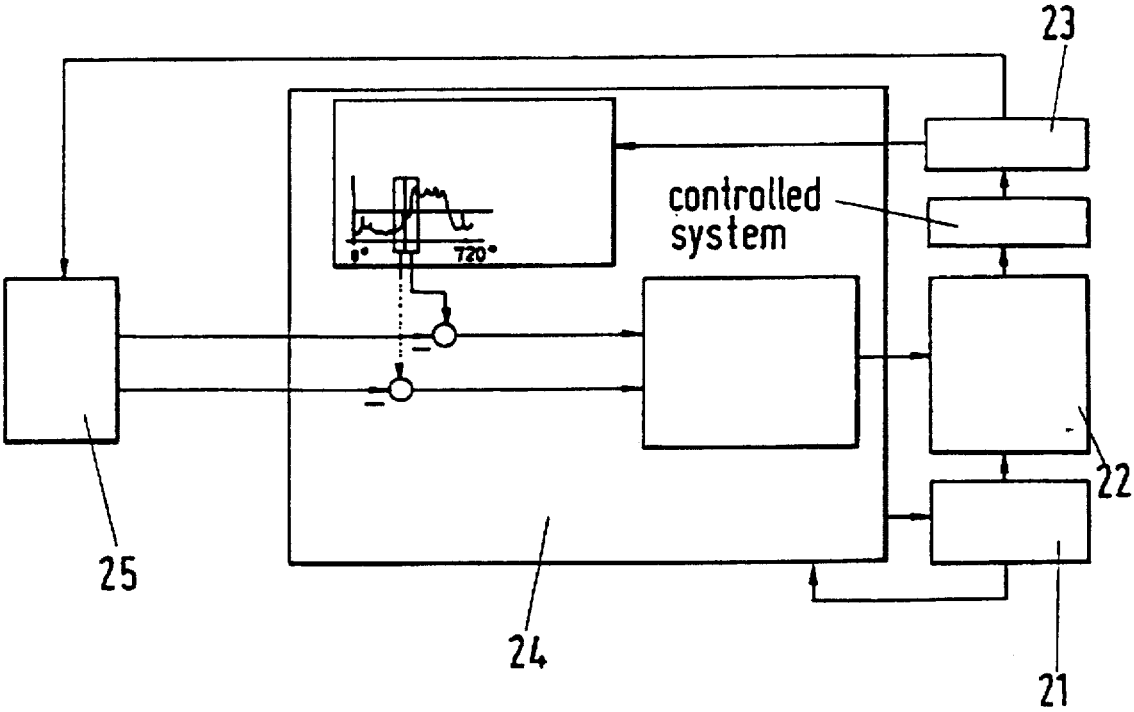
FIG. 9 is a control structure for producing the control curve of FIG. 8.

FIG. 9 shows a control structure for performing the control. This control structure comprises a control device 21 which is part of a machine control (not shown) an actively controllable yarn rest 22, the process controlled system, i.e. the path of the warp yarn from the warp beam to the cloth edge, a pressure meter 23 with measurement values proportional to the yarn tension, a device 24 for determining the control characteristic and a device 25 for presetting or automatically adjusting the desired values of the yarn tension.

Conventional logic elements or fuzzy-logic can be provided for the control.

We claim:

1. Method for controlling weft yarn tension and warp yarn tension in a weaving machine having a drive shaft which rotates through discrete positions of shaft rotation to cause yarn being woven in the weaving machine to come under variable tension as a function of shaft rotation, the method of controlling yarn tension comprising the steps of:

selecting at least one desired yarn tension value for yarn in the weaving machine;

measuring a first actual yarn tension data in the weaving machine as a function of shaft rotation and yarn tension at discrete positions of shaft rotation;

calculating a first tension control curve as a function of shaft rotation and yarn tension at discrete positions of shaft rotation by comparing the desired yarn tension value with the measured first actual yarn tension data to cause actual yarn tension in the weaving machine to approach the desired yarn tension value;

applying the first tension control curve to the weaving machine by varying at least one of the control parameters from the group consisting of measured yarn tension, values of yarn breakage, braking force, time of braking force as a function of shaft rotation, beat up force of reed or shed, opening of the shed, through pass time of inserted weft yarn, fastener or clip inclination of warp yarn, warp let off, yarn rest, and cloth take off;

measuring a second actual yarn tension data in the weaving machine as a function of shaft rotation and yarn tension at discrete positions of shaft rotation with the first tension control curve applied to the weaving machine;

calculating a second tension control curve as a function of shaft rotation and yarn tension at discrete positions of shaft rotation by comparing the desired yarn tension value with the measured second actual yarn tension data to cause actual yarn tension in the weaving machine to further approach the desired yarn tension value;

applying the second tension control curve to the weaving machine by varying at least one of the control parameters from the group consisting of measured yarn tension, values of yarn breakage, braking force, time of braking force as a function of shaft rotation, beat up force of reed or shed, opening of the shed, through pass time of inserted weft yarn, fastener or clip inclination of warp yarn, warp let off, yarn rest, and cloth take off; and, weaving with the weaving machine having the second tension control curve applied to the weaving machine to further approach the desired yarn tension value.

2. Method for controlling weft yarn tension and warp yarn tension in a weaving machine according to claim 1 and wherein the step of applying one of the tension control curves includes:

varying the phase of the control curve as a function of shaft rotation and yarn tension at discrete positions of shaft rotation to determine adjustment with the least deviation from the desired yarn tension value.

3. Method for controlling weft yarn tension and warp yarn tension in a weaving machine according to claim 1 and the step of applying one of the tension control curves includes:

varying the amplitude of the control curve as a function of shaft rotation and yarn tension at discrete positions of shaft rotation to cause actual yarn tension in the weaving machine to further approach the desired yarn tension value.

4. Method for controlling weft yarn tension and warp yarn tension in a weaving machine according to claim 1 and the step of applying one of the control curves includes:

varying the amplitude and the phase, of the control curve alternatingly to cause actual yarn tension in the weaving machine to further approach the desired yarn tension value.

5. Method for controlling weft yarn tension and warp yarn tension in a weaving machine according to claim 1 and the step of applying one of the control curves includes:

holding the amplitude constant and varying the phase between two selective values to cause actual yarn tension in the weaving machine to further approach the desired yarn tension value.

6. Method for controlling weft yarn tension and warp yarn tension in a weaving machine according to claim 1 and the step of applying one of the control curves includes:

holding the phase constant and varying the amplitude between two selective values to cause actual yarn tension in the weaving machine to further approach the desired yarn tension value.

7. Method for controlling weft yarn tension and warp yarn tension in a weaving machine according to claim 1 and the step of applying one of the control curves includes:

calculating the control curve for at least one parameter from the group consisting of position of the adjustment elements, yarn breakage analysis, fastener or clip inclination of the warp yarns, beat-up force of the reed, shed geometry, and through-pass time of the weft yarn.

8. Method for controlling weft yarn tension and warp yarn tension in a weaving machine according to claim 7 and including the further steps of:

compensating at least one of the control curves per two weft insertions.

9. Method for controlling weft yarn tension and warp yarn tension in a weaving machine according to claim 1 and the step of applying one of the control curve includes:

predetermining the control curve for at least one weft insertion to observe tension variation.

10. Method for controlling weft yarn tension and warp yarn tension in a weaving machine according to claim 1 and the step of applying one of the control curves includes:

predetermining the control curve for the duration of a pattern repeat to observe woven cloth.

11. Method for controlling weft yarn tension and warp yarn tension in a weaving machine according to claim 1 and the step of applying one of the control curve includes:

having the second control curve continually preset.

12. Method for controlling weft yarn tension and warp yarn tension in a weaving machine according to claim 1 including the step of:

storing the data of the second control curve in a storage medium.

* * * * *